US005199220A

United States Patent [19]

Steiner et al.

[11] Patent Number: 5,199,220

[45] Date of Patent: Apr. 6, 1993

[54] COMBINATION BELT AND DISC SANDER

[75] Inventors: Robert E. Steiner; Daniel A. Terpstra, both of St. Louis County, Mo.; Steven H. Plume, Madison County, Tenn.

[73] Assignee: Emerson Electric Co., St. Louis, Mo.

[21] Appl. No.: 901,181

[22] Filed: Jun. 19, 1992

[51] Int. Cl.[5] ..... B24B 21/00

[52] U.S. Cl. ..... 51/3; 51/147; 51/273

[58] Field of Search ..... 51/3, 4, 134.5 R, 147, 51/166 R, 166 TS, 166 MH, 181 R, 266, 273, 148, 135 BT, 135 R

[56] References Cited

U.S. PATENT DOCUMENTS

| | | | |
|---|---|---|---|
| D. 293,763 | 1/1988 | Arehart | D 8/62 |
| 1,951,105 | 3/1934 | Myers | 51/273 |
| 2,232,149 | 2/1941 | Tautz | 51/273 |
| 2,251,442 | 8/1941 | Emmons | 51/273 |
| 2,483,369 | 9/1949 | Loucony et al. | 51/3 |
| 3,538,650 | 11/1970 | Pollack | 51/148 |
| 4,305,231 | 12/1981 | Rasmussen | 51/148 |
| 4,335,542 | 6/1982 | Howe | 51/3 |
| 4,403,454 | 9/1983 | Glore et al. | 51/135 BT |

FOREIGN PATENT DOCUMENTS

| | | | |
|---|---|---|---|
| 412704 | 2/1946 | Italy | 51/135 R |

*Primary Examiner*—Bruce M. Kisliuk
*Assistant Examiner*—Bryan Reichenbach
*Attorney, Agent, or Firm*—Polster, Lieder, Woodruff & Lucchesi

[57] ABSTRACT

A combined belt and disc sander is disclosed which provides a belt sander than can be pivoted from a horizontal to vertical position, a disc sander that is fixed below the upper horizontal plane of the belt sander, and a drive motor assembly than can drive both the belt sander and disc sander. A movable work table for supporting a workpiece is capable of being used with the belt sander or the disc sander, as may be desired. The angle of the work table relative to the belt sander or the disc sander can be adjusted so that the workpiece can be placed at the desired angle relative to the belt or disc sander. The sander further includes a sawdust collection mechanism that can be attached to a utility vacuum cleaner.

13 Claims, 4 Drawing Sheets

COMBINATION BELT AND DISC SANDER

BACKGROUND OF THE INVENTION

The present invention relates to electric sanders, and more particularly, to a combination belt sander and disc sander.

Electric sanders are usually one of two types. The first type, commonly referred to as a belt sander, contains an endless belt bearing an abrasive surface which moves along an endless horizontal pathway. Typically, the workpiece is placed upon the abrasive surface and manipulated in relation to the continuously moving belt, so as to expose the surface of the workpiece to the moving abrasive belt. Generally, the workpiece is placed on top of the belt. This type of sander is particularly suited for sanding the horizontal surface on a flat workpiece, for example, the top or bottom side of a flat workpiece. Therefore, depending upon the configuration of the workpiece or the area on the workpiece the user wants to sand, a horizontal belt sander may not be appropriate.

The second common type of sander is a disc sander which typically has a disc with an abrasive surface that rotates about a central axis. The disc is generally situated in a vertical plane relative to the workpiece and is commonly employed to sand the end or a side of a workpiece.

A typical user of power tools, who engages in woodworking or finishing, may find it necessary to use two different types of sanders, a belt sander and a disc sander, in order to adequately sand or finish a workpiece to a particular configuration. It would be an advantage, therefore, to have an electric sander device that employs both a belt sander and a disc sander.

Such a device is available, as shown in U.S. Design Pat. No. 293,763, so as to provide both types of sanders in a single device. A combined belt and disc sander of this type facilitates a woodworking operation by enabling the user to quickly use either the belt or disc sander in a single device. However, there are several disadvantages with this combined unit. Since the disc sander and belt sander are mounted on the same drive shaft, the disc sander necessarily obstructs the work area of the belt sander.

To optimally use a combined belt and disc sander, the top of the disc sander should be mounted below the belt sander, in order to provide an unobstructed work area, on and around the sanding belt when operating in a horizontal position. The supporting work table should also be capable of being used with both the disc sander as well as the belt sander when the belt sander is in a horizontal position. Furthermore, when used with the belt sander, the latter is capable of being moved to a vertical position, with the work table being movably mounted for use in conjunction with the vertically operating belt sander.

Moreover, to enhance the versatility of such a combination sander, the work table should be capable of angular adjustment relative to the either the disc or belt sander surface so that the supported workpiece can be placed at a desired angle for exposure to the sanding surface. For example, a beveled edge of a workpiece could be sanded at an appropriate angle if the work table can be adjusted angularly relative to the sander. Furthermore, the combination sander should have a motorized drive mechanism employing one electric motor that can drive both the belt sander and the disc sander, to enable the device to be easily and economically manufactured and assembled.

SUMMARY OF THE INVENTION

Among the several objects and advantages of the present invention may be noted:

The provision of a new and improved combination belt and disc sander that enables the disc sander to be mounted below the horizontal plane of the belt sander, in order to provide an unobstructed work area on and around the belt sander when operated in a horizontal position;

The provision of the aforementioned new and improved combined belt and disc sander which provides a moveable supporting work table, for use with either the disc sander or belt sander;

The provision of the aforementioned combined belt and disc sander where the belt sander is capable of being moved to a vertical position, for use with the movable supporting work table;

The provision of the aforementioned combined belt and disc sander in which the movable supporting work table is further capable of angular adjustment relative to either the disc or belt sander to enable a supported workpiece to be placed at a desired angle for exposure to a sanding surface;

The provision of the aforementioned combined belt and disc sander which employs a single motor for driving both the belt and disc sander;

The provision of the aforementioned combined belt and disc sander which further contains a sawdust collecting mechanism for a single hookup to a utility vacuum;

The provision of the aforementioned combined belt and disc sander in which the disc sander further contains vanes on the rear side of the disc thereby acting as a blower to aid sawdust removal from the disc sander; and The provision of the combined belt and disc sander which enables safe and efficient operation; has a durable and long lasting construction; is made from a relatively minimum number of parts considering the nature of the device; and is otherwise well adapted for the purpose intended.

Briefly stated, a combined belt and disc sander includes a housing, a belt sander attached to and extending across the upper surface of the housing, a disc sander attached to the side surface of the housing and positioned below the belt sander, and a motor that drives both the belt sander and disc sander;

The motor has a double-ended shaft, the first shaft end drives the belt sander and a second shaft end drives the disc sander.

The belt sander extends horizontally across the upper surface of the housing and is movable from a horizontal to a vertical position. The disc sander is mounted to the side of the housing. A removably mounted work table is also provided that is capable of being mounted relative to the disc sander or relative to the belt sander when the belt sander is in a horizontal or vertical position.

The removably mounted work table is capable of angular adjustment so that the angle of placement of the work table relative to either the disc or belt sander can be adjusted;

A sawdust collector mechanism for collecting sawdust from both the belt sander and disc sander is also provided in the housing. The sawdust collector mechanism is capable of being connected to a utility vacuum for drawing sawdust from the housing.

DESCRIPTION OF THE PREFERRED EMBODIMENT

The following detailed description illustrates the invention by way of example and not by way of limitation. The description will clearly enable one skilled in the art to make and use the invention, and describe several embodiments, adaptions, variations, alternatives and uses of the invention, including what we presently believe is the best mode of carrying out the invention.

Figure 1:
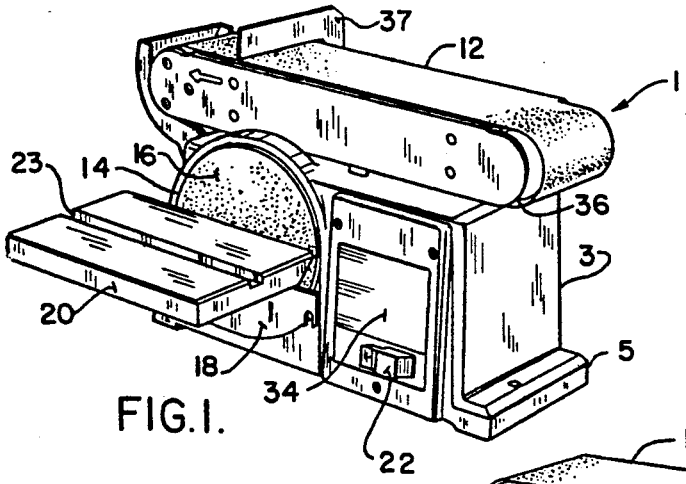
FIG. 1 is a front perspective view of the combined disc and belt sander of the present invention.
Figure 2:
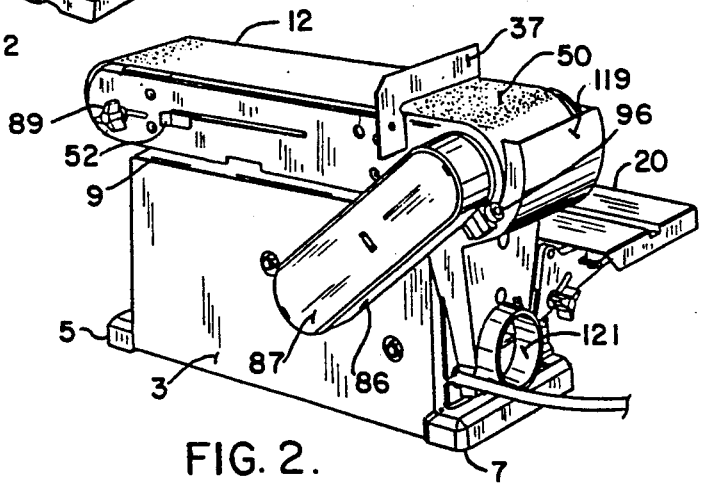
FIG. 2 is a rear perspective view of the combined belt and disc sander of the present invention.
Figure 3:
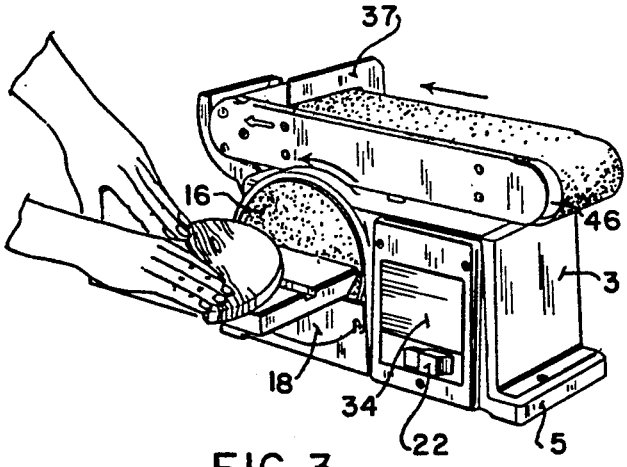
FIG. 3 is a perspective view of the combined belt and disc sander of the present invention in use demonstrating the use of the disc sander.
Figure 4:
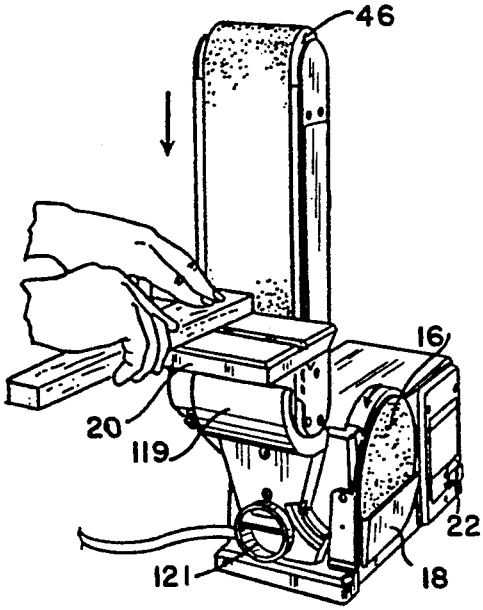
FIG. 4 is a perspective view of the combined belt and disc sander of the present invention in use demonstrating the use of the belt sander in a vertical position.
Figure 7:
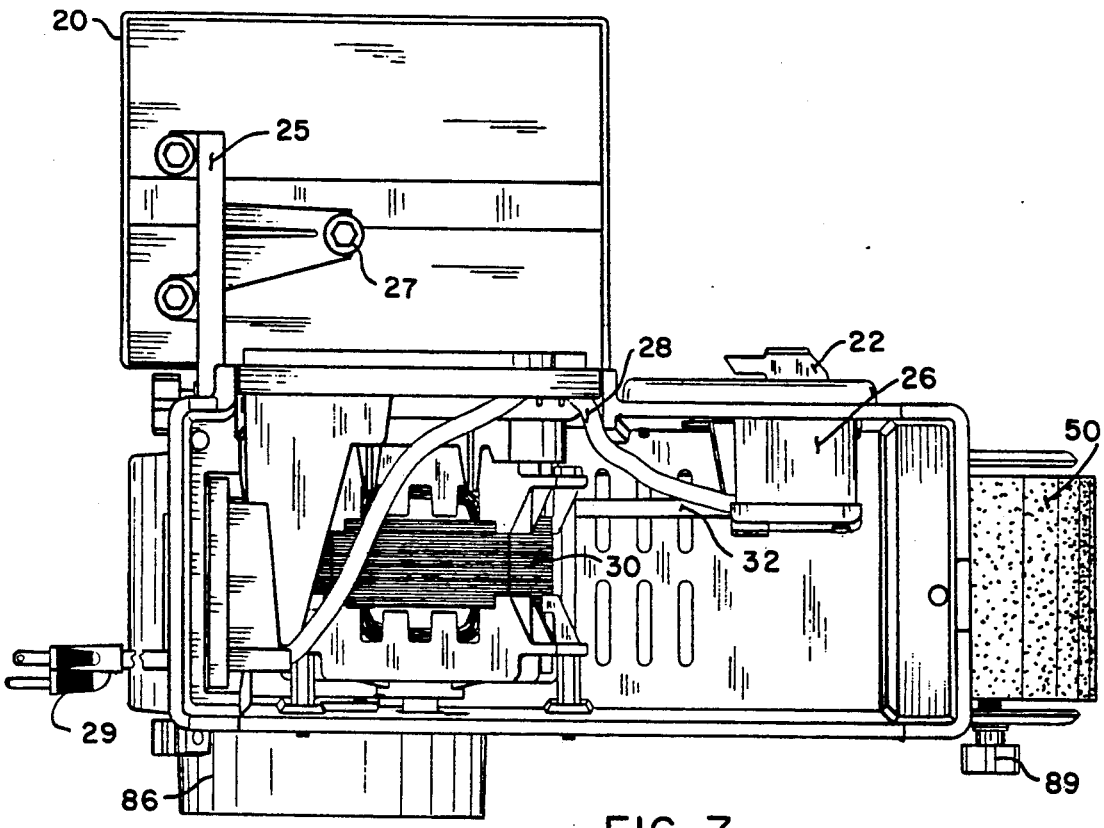
FIG. 7 is a bottom plan view thereof on the same scale as FIG. 5.
Figure 8:
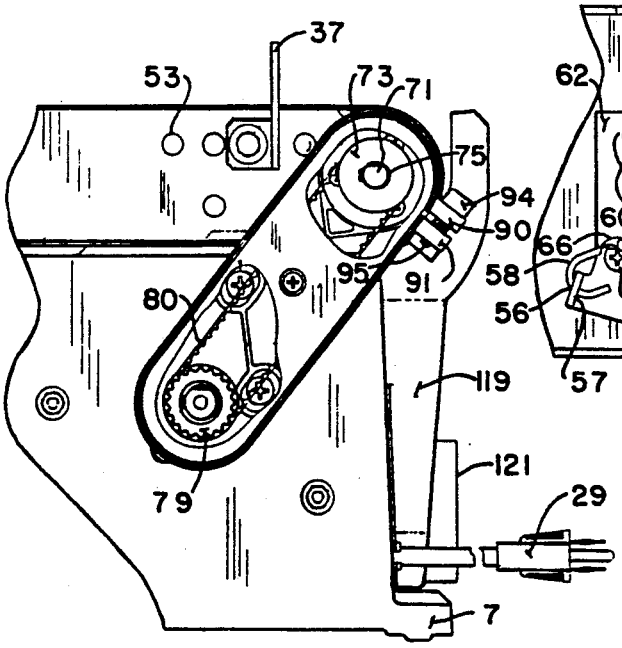
FIG. 8 is a fragmentary side elevational view on the same scale as FIG. 5 which illustrates components of the belt sander drive mechanism.
Figure 9:
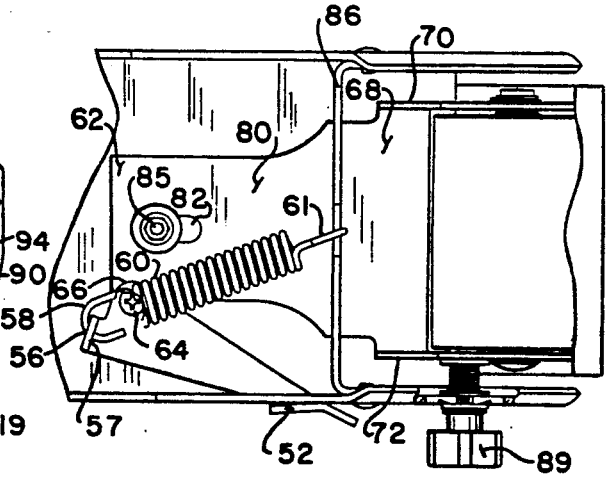
FIG. 9 is a fragmentary bottom plan of the belt sander portion of the present invention on the same scale as FIG. 5 illustrating the belt sander tension mechanism.

Reference is now made to FIGS. 1–6 of the drawings which illustrate the fully assembled components of the combined belt and disc sander 1. FIGS. 3 and 4 are isometric views of various components of combined belt and disc sander 1 in use. FIGS. 7–9 are various fragmentary views showing principal operating components of sander 1 of the present invention and FIG. 10 is an exploded isometric view of sander 1 showing in detail, all of the principal operating components.

In FIGS. 1 and 2 of the drawings, the sander 1 is shown as including a motor housing 3 which is essentially a rectangular box shape that incorporates base feet 5 and 7 which are formed or attached to opposite sides of housing 3 along the bottom thereof. The flat horizontal upper surface 9 of housing 3 contains a plurality of ventilating slots 11 to allow hot air to be exhausted from the interior of housing 3. A belt sander, shown generally at 12, is mounted over the top of housing 3. Disc sander, shown generally at 14, is mounted on one side of housing 3 below the top horizontal plane of belt sander 12. Disc sander 14 contains a sanding disc 16, of abrasive material for sanding a workpiece. A disc guard 18 is attached to housing 3 and is provided to protect the user from unwanted or dangerous contact with abrasive disc 16. Work table 20 is affixed to housing 3 relative to disc sander 14 in FIGS. 1–3 and 5–7. Work table 20 is affixed to sander bed 36 relative to belt sander 12 in FIG. 4 as will be described in detail below.

Figure 6:
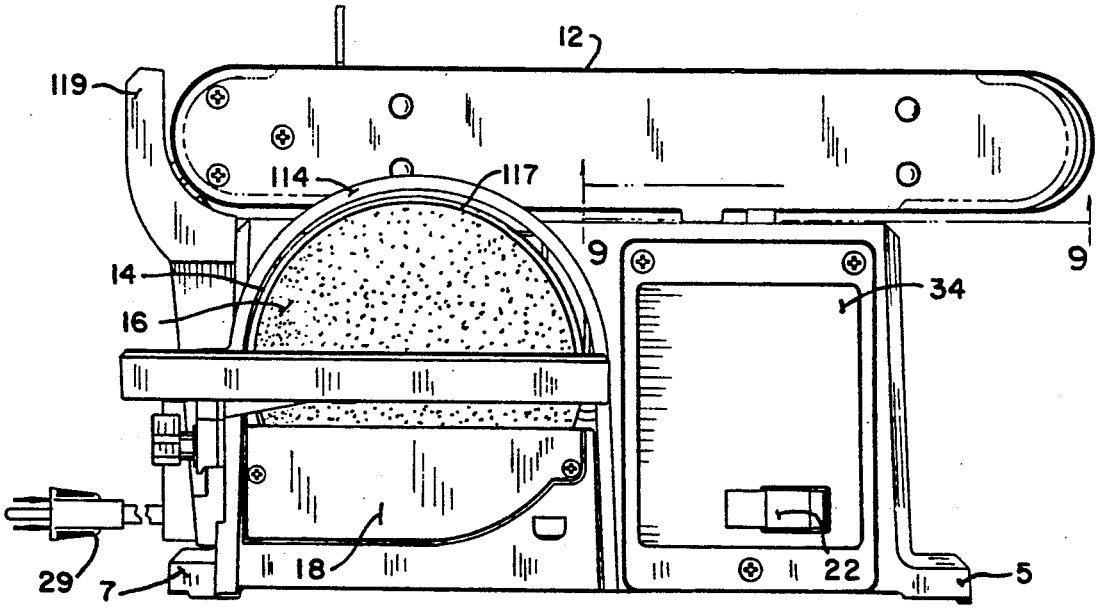
FIG. 6 is a side elevation view thereof on the same scale as FIG. 5.

Locking switch 22 protrudes through housing 3 and is used to activate the sanders (FIG. 6). A switching mechanism 24 (FIG. 10) is cooperatively connected to locking switch 22 and is mounted inside switch housing 26 (FIG. 7). Switch mechanism 24 is attached to cord 28 and electrically connected to motor 30 through wire 32. As shown in FIGS. 1 and 3 of drawings, a machine label 34 for designating the name of the manufacturer or distributor or other sander identifying information, as may be desired, is affixed to housing 3.

Figure 10:
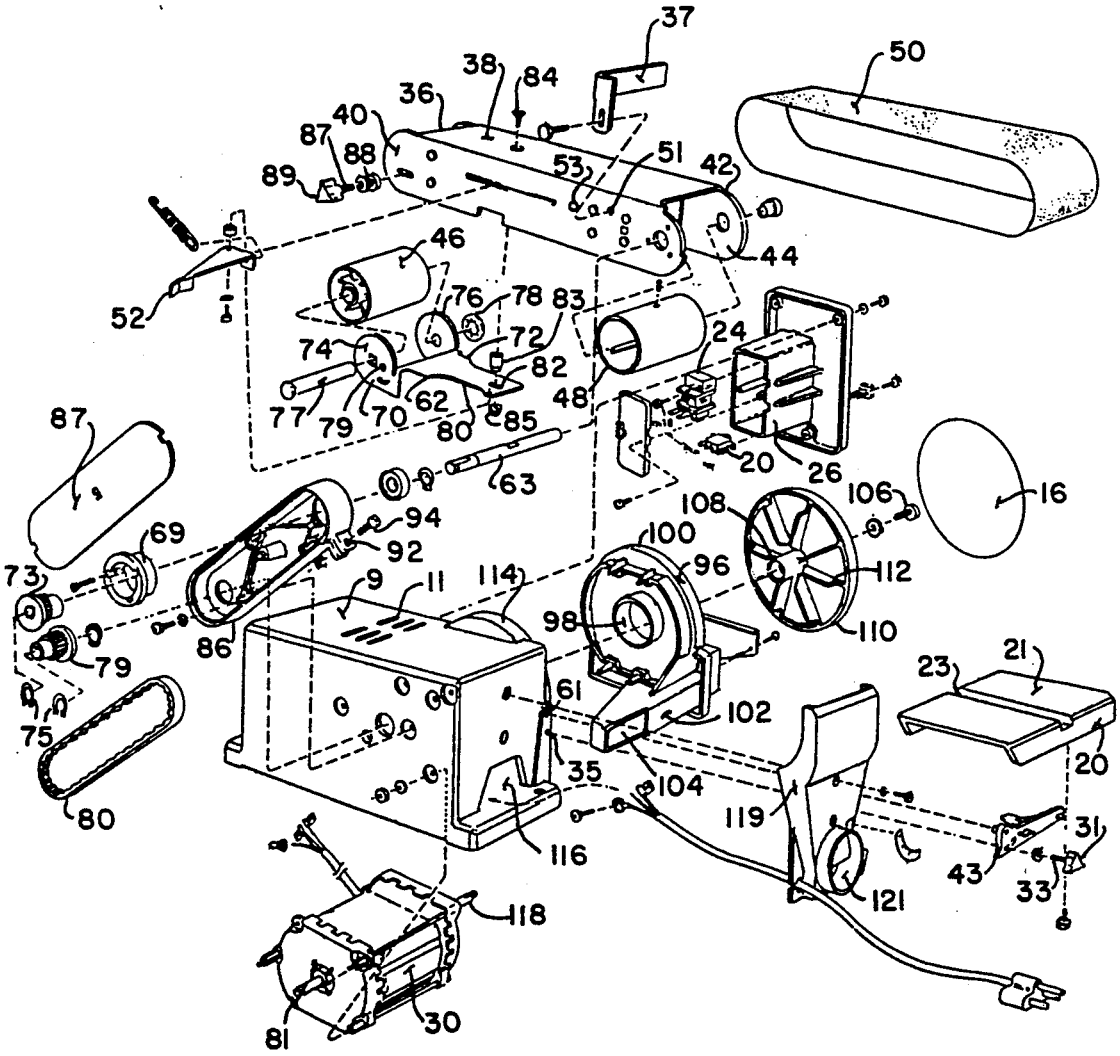
FIG. 10 is an exploded, isometric view illustrating the component parts of the combined disc and belt sander of the present invention.

Turning now to a more detailed description of the belt sander component of the device, belt sander 12 consists of sander bed 36, having a substantially flat, elongate top 38 and parallel, elongate sides 40 and 42 which form channel 44 (FIG. 10). Idler drum 46 and drive drum 48 are mounted in each end of channel 44. An abrasive sanding belt 50 is positioned over idler drum 46 and drive drum 48 and covers bed 36. Sanding belt 50 is disposed to move along an endless path around idler drum 46 and drive drum 48 during operation. This moving abrasive belt is used to sand and finish a workpiece (not shown) placed upon bed 36. The workpiece can be braced against work support 37 which extends over belt 50 as will subsequently be explained.

The abrasive belt 50 is subject to wear and the abrasive quality deteriorates. Therefore, the worn belt 50 can be removed and replaced with a new belt as needed. To place sanding belt 50 over idler drum 46 and drive drum 48, tension lever 52 is released and idler drum 46 moves backward slightly toward drive drum 48, thereby reducing the distance between idler drum 46 and drive drum 48 and allowing sanding belt 50 to be slipped over drums 46 and 48. When sanding belt 50 is secured over drums 46 and 48 covering bed 36, tension lever 52 is activated, increasing the distance between drums 46 and 48 to snuggly engage sanding belt 50. FIG. 9 best illustrates the belt securing mechanism.

Tension lever 52 has lip 57 containing hole 56 for engaging hooked end 58 of tension spring 60. Tension lever 52 is attached to idler drum bracket 62 by suitable attaching means 64 through pivot 66. Bracket 62 has a generally flat webbed surface 68 with parallel sides 70 and 72 protruding downward from surface 68 and rounded ears 74 and 76 extending upward behind surface 68. Drum 46 slides over axle 77 and is secured between ears 74 and 76 by retaining ring 78. Bracket 62 has elongate portion 80 containing elongate slot 82. A screw 84 or other appropriate means, extends down through bed 36 and spacer 83 through slot 82 and is secured with an appropriate nut or other means 85. Slot 82 is oversized relative to spacer 83 so that bracket 62 can move back and forth. Tension spring 60 is attached at hooked end 61 to spring mount 86 which is rigidly mounted inside channel 44, being affixed to the sides 40 and 48 with rivets or appropriate means (not shown).

When tension lever 52 is activated, it moves about pivot 66 thereby increasing tension in spring 60 and biasing bracket 62 and drum 46 away from drum 48. When tension lever 52 is released, it moves about pivot 66 releasing spring tension from bracket 62 and drum 46, allowing bracket 62 with drum 46 to move slightly closer to drum 48 thereby allowing sanding belt 50 to be slipped over drum 46 and 48.

The abrasive belt 50 should be properly positioned and centered over bed 36 for optimal operation of belt sander 12. Proper alignment of belt 50, idler roller 46 and drive roller 48 within channel 44 assures smooth and efficient operation of the belt sander. Side to side alignment of the roller mechanism can be adjusted as follows: ear 74 on bracket 62 has hole 79 threaded to engage thread 87 on knob 89. Side to side alignment of bracket 62 and drum 46 within channel 44 is adjusted by turning knob 89 which causes thread 87 to move in or out of hole 79 thereby moving bracket 62 and idler drum 46 against spacer spring 88 within channel 44 until the desired alignment of idler drum 46 inside channel 44 is achieved.

To sand or finish a workpiece on belt sander 12, the user places the workpiece against moving belt 50. Work support 37 is attached to side 40 of bed 36 and extends over sanding belt 50 so as to brace the workpiece (not shown) when belt sander 12 is in operation. Sanding belt 50 rotates over idler drum 46 and drive drum 48 toward support 37 thereby drawing a workpiece (not shown) backward toward work support 37. The movement of sanding belt 50 forces the workpiece against the work support 37, whereby work support 37 keeps the workpiece in the position desired by the user and, furthermore, keeps the workpiece from being jerked or pulled out of the user's hands by the force of the moving abrasive belt 50.

Figure 5:
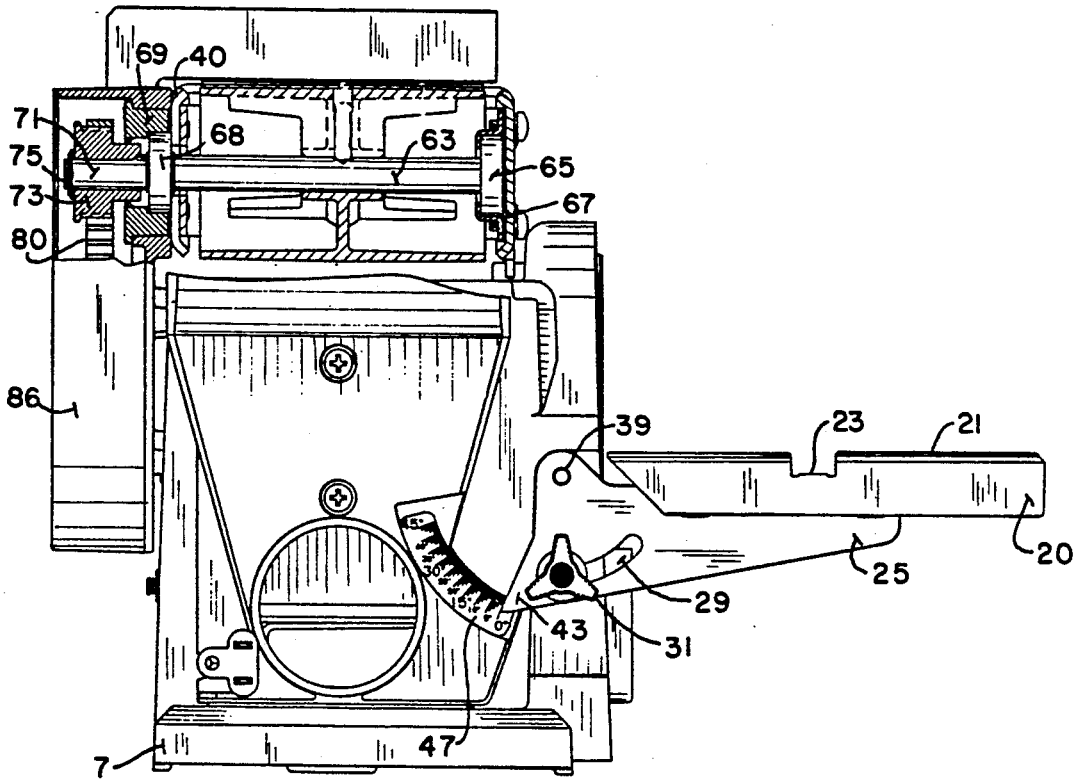
FIG. 5 is an enlarged end elevational view partly in section of the combined belt and disc sander of the present invention.

Sanding belt 50 moves along an endless path driven by the mechanism best illustrated in FIGS. 5 and 8. Shaft 63 having bearing 65 and 68 at each end extends through drive drum 48. Bearing 65 is seated in bearing cup 67 and bearing 68 is seated in bearing support 69. Bearing support 69 is firmly affixed to side 40 of bed 36. Shaft 63 has an extension 71 of slightly lesser diameter than shaft 63 on which is mounted pulley 73 and retained by spring washer 75 or other appropriate means. Drive belt 80 engages pulley 73 and loops around motor pulley 79 mounted on shaft 81 extending from motor 30. Motor 3 receives electric current through electric cord 28 having plug 29 that can be plugged into a conventional electrical outlet (not shown). In operation, therefore, motor 30 turns shaft 81 and pulley 79 which engages belt 80 thus turning pulley 73 to drive shaft 63 which in turn, drives drive roller 48 thereby driving sanding belt 50 in an endless path for sanding as desired.

The drive mechanism is protected by a belt cover 87 and shroud 86. Shroud 86 also serves as a locking apparatus for securing sander 12 in a horizontal or vertical position. Shroud 86 surrounds bearing support 69 (FIG. 5) which is firmly attached to side 40 as described above. Lips 91 and 90 on shroud 86 have holes 92 for seating hex screw 94 or other appropriate means. Shroud 86 is drawn tightly against support 69 by tightening screw 94 and square nut 95. When shroud 86 presses tightly against support 69, bed 36 of sander 12 cannot move. To move bed 36 to a vertical position (FIG. 4), hex screw 94 is loosened, thereby freeing support 69 from the shroud and allowing support 69 to rotate within shroud 86 and thereby allowing bed 36 to rotate to a vertical position. Work support 37 can be removed when belt sander 12 is placed in a vertical position (FIG. 4) so that work table 20 can be mounted relative to belt sander 12 as will be subsequently explained.

A detailed description of work table 20 now follows: work table 20, attached to housing 3, has a planar top 21 on which a workpiece (not shown) can rest. Planar top 21 has a miter gauge slot 23 for receipt of a miter gauge (not shown). Table 20 is affixed to bracket 25 with bolts 27 or other suitable means for attaching (see FIG. 7). Work table 20 can be adjusted angularly relative to the disc sander 14 so that the user can sand or finish a beveled edge or similarly angular workpiece. Bracket 25 has an arcuate groove 29 through which fastening knob 31, having threaded portion 33, (FIG. 10) slides and is screwed into hole 35. Bracket 25 is a generally triangular shaped web, having a pivot stud 39 on the posterior portion of the web at the peak angle for engaging hole 61 (FIG. 10). When table 20 is mounted relative to disc sander 14, angle 43 of bracket 25 functions as a pointer. Knob 31 can be loosened and bracket 25 can be pivoted about stud 39 until the desired angle of table 20 relative to sander 14 is reached. Angle 43 points to scale 47 to give a reading of the degree of angular tilt of table 20 (FIG. 5).

Work table 20 can be affixed relative to the belt sander 12 when belt sander 12 is moved to a horizontal or vertical position as will be explained in more detail below. Briefly, however, hex screw 94 (FIG. 8) is loosened, and bed 36 pivoted on shaft 63 to an upright position (FIG. 4). As previously described, work support 37 is removed and table 20 is installed relative to belt sander 12. To mount work table 20 on belt sander 12, knob 31 engages hole 51 and pivot 39 is inserted in hole 53 on side 40 of belt sander 12. Knob 31 can be tightened to firmly secure table 20 relative to sanding belt 50 when belt sander 12 is in the horizontal or vertical position.

Turning now to a more detailed description of the disc sander which is shown generally at 14. Sander 14 is mounted on the side of housing 3 below the horizontal plane of belt sander 12. As best illustrated in FIG. 10, sander 14 is comprised of a disc shroud 96 having central hole 98, circular recess 100, and base 102 with dust port 104 and dust slot (not shown) under recess 100 both formed therein. Base 102 also serves as part of the dust collector mechanism as will subsequently be explained. Sanding disc 16 is affixed with appropriate adhesive to disc casting 110. Disc casting 110, having fan blades 112 formed on the posterior side which serve to both cool motor 30 and to draw sawdust into base 102, as will be explained in detail below, fits within shroud 96 with a slight space 117 (FIG. 6) created between casting 110 and shroud 96. Disc shroud 96 is mounted in housing 3 inside shroud housing 114 with dust port 104 being aligned with opening 116. Base 102 serves as a manifold for collecting dust and also serves to seal the area inside housing 3 and protects motor 30 from sawdust. Hub 108 fits in central hole 98 and seats within recess 100. Shaft end 118 on motor 30 is attached to hub 108 with screw 106 so that the motor 30 can drive disc casting 110 with shaft end 118 and drive belt sander 12 with shaft end 81 as described above.

Dust collector 119 is mounted to housing 3 at an end of belt sander 12 and is disposed to collect sawdust generated by using the belt sander or the disc sander. Dust collector 119 is mounted on housing 3 at the end of belt sander 12, having a port 121 molded therein and alignable with opening 116 in housing 3.

In operation, abrasive belt 50 rotates toward the mouth of collector 119 and sawdust from a workpiece (not shown) moves into the mouth of collector 119 and out of port 121. When sander 12 is in vertical position as described above, sander belt 50 moves along an endless path downward carrying sawdust into the mouth of collector 119 and out through port 121.

Furthermore, in operation, the user can place a workpiece (not shown) on table 20 when table 20 is mounted relative to disc sander 14 as shown in FIG. 3. As disc casting 110 rotates, blades 112 (FIG. 10) create an airflow drawing sawdust into space 117 (FIG. 6), through recess 100 into the slot (not shown) formed in base 102, out of port 104 through opening 116 in housing 3 and out of port 121. In either case, a conventional utility vacuum cleaner hose (not shown) can be attached to port 121 to rid the work area and sander of sawdust.

In view of the above, it will be seen that the several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

We claim:

1. A combined belt and disc sander comprising:

a housing;

a belt sander attached to and extending across an upper surface of the housing;

a disc sander attached to a side surface of said housing, said disc sander in its entirety being positioned below a top horizontal surface of said belt sander; and motor means within said housing and operatively connected to both said belt sander and said disc sander for joint operation thereof.

2. The device of claim 1 wherein the motor means further comprises a first shaft end for driving the belt sander and a second shaft end for driving the disc sander.

3. The device of claim 1 wherein the belt sander further comprises a pivot for rotating the belt sander from a horizontal position to a vertical position.

4. The device of claim 2 wherein the motor means for driving the disc sander and the belt sander further comprises two drive shafts, the first drive shaft disposed to drive the belt sander and the second drive shaft disposed to drive the disc sander.

5. A combined belt and disc sander comprising:

a housing;

a belt sander attached to and extending horizontally across an upper surface of the housing, said belt sander being movable from its horizontal position to a vertically extending position relative to said housing;

a disc sander attached to a side surface of said housing, said disc sander in its entirety being positioned below a top horizontal surface of said belt sander; and a removably mounted work table capable of being mounted relative to said disc sander or to said belt sander when the latter is in its horizontal or vertically extending position for supporting workpieces relative to said disc sander and/or belt sander.

6. The device of claim 5 wherein the work table further comprises means for angular positioning of the work table relative to a sander.

7. The device of claim 6 wherein the means for angular positioning of the work table further comprises a work table support means having a circumferential slot in the support means, said slot being alignible with a tapped hole in the assembly housing assembly, said slot can be moved relative to the tapped hole in the housing.

8. The device of claim 7 wherein the means for angular positioning of the work table further comprises a locking means, said locking means comprising a threaded knob, said knob is passable through the circumferential slot, said threaded knob being disposed to engage a tapped hole in the housing.

9. A combined belt and disc sander comprising:

a housing;

a belt sander attached to and extending across an upper surface of the housing;

a disc sander attached to a side surface of said housing, the disc sander in its entirety being positioned below a top horizontal surface of said belt sander;

motor means within said housing for operating said belt and disc sander; and sawdust collection means for collecting sawdust within said housing from both said belt sander and said disc sander and for conveying said sawdust to a single exhaust opening to which an independent utility vacuum may be connected.

10. The device of claim 9 wherein the means for collecting sawdust further comprises a collecting manifold mounted at one end of the belt sander.

11. The device of claim 10 wherein means for collecting sawdust further comprises a fan mounted behind the disc sander, said fan being disposed to create an airflow for pulling the sawdust into the collecting manifold located at one end of the belt sander.

12. The device of claim 11 wherein the fan further comprises a means for cooling the motor assembly.

13. The device of claim 9 wherein the motor means further comprises means for driving the belt sander and driving the disc sander.

* * * * *

UNITED STATES PATENT AND TRADEMARK OFFICE

CERTIFICATE OF CORRECTION

PATENT NO. : 5,199,220

DATED : April 6, 1993

INVENTOR(S) : Robert E. Steiner et al.

It is certified that error appears in the above-identified patent and that said Letters Patent is hereby corrected as shown below:

Claim 7, Column 8, Line 15 is "the assembly housing assembly", should be -- the housing --.

Signed and Sealed this

Eighteenth Day of January, 1994

*Attest:*

Bruce Lehman

BRUCE LEHMAN

*Attesting Officer*

*Commissioner of Patents and Trademarks*